US005819892A

United States Patent [19]

Deliman et al.

[11] Patent Number: 5,819,892

[45] Date of Patent: Oct. 13, 1998

[54] APPARATUS FOR RELEASABLY LOCKING AN ADJUSTABLE LUGGAGE HANDLE

[75] Inventors: Lawrence J. Deliman, Aurora; Roger Pedlar, Golden; Elliot Younessian, Westminster, all of Colo.

[73] Assignee: Samsonite Corporation, Denver, Colo.

[21] Appl. No.: 847,993

[22] Filed: Apr. 21, 1997

Related U.S. Application Data

[60] Provisional application No. 60/015,622, Apr. 19, 1996.

[51] Int. Cl.[6] ..... A45C 5/14; A45C 13/26

[52] U.S. Cl. ..... 190/115; 190/18 A; 190/39; 16/115; 280/37

[58] Field of Search ..... 190/39, 115; 16/115; 280/37, 655, 655.1

[56] References Cited

U.S. PATENT DOCUMENTS

| | | | |
|---|---|---|---|
| 3,522,955 | 8/1970 | Warner, Jr. | 16/115 X |
| 4,087,102 | 5/1978 | Sprague | 16/115 X |
| 5,374,073 | 12/1994 | Hung-Hsin | 16/115 X |
| 5,414,895 | 5/1995 | Kazmark, Jr. | 16/115 |
| 5,421,605 | 6/1995 | Chen | 280/655 |
| 5,438,731 | 8/1995 | Kazmark, Jr. | 16/115 |
| 5,499,426 | 3/1996 | Hsieh | 280/655 X |
| 5,513,873 | 5/1996 | Chen | 16/115 X |
| 5,524,503 | 6/1996 | Ishikura | 16/115 X |
| 5,630,488 | 5/1997 | Chen | 190/115 |
| 5,639,109 | 6/1997 | Liang | 16/115 X |
| 5,642,552 | 7/1997 | Wang | 190/115 X |
| 5,692,266 | 12/1997 | Tsai | 280/655.1 X |

*Primary Examiner*—Sue A. Weaver
*Attorney, Agent, or Firm*—Rod D. Baker; Gregory W. O'Connor

[57] ABSTRACT

There is provided a wheel handle whose functional length is easily extended or shortened with respect to a wheeled luggage case. The wheel handle includes a handle grip mounted atop a pair of longitudinal tubes or rods slidable axially through a bezel fixed upon the luggage case. A mechanism including a minimal number of moving parts permits the user to lock and unlock the position of the extendible/collapsible wheel handle with the press of a spring-biased button. The button movement actuates a helical cam, which rotates a cam follower. Rotation of the cam follower extends or retracts a pair of sliding pins engageable into holes in the longitudinal handle tubes. With the button depressed against the force of the spring, the pins are withdrawn to allow adjustment of the effective handle length. Releasing the button, while the pins are aligned with a selected pair of apertures in the tubes allows the force of the spring to restore the button to its rest position, with the pins engaged into tube apertures to releasably lock the luggage handle in place.

15 Claims, 5 Drawing Sheets

APPARATUS FOR RELEASABLY LOCKING AN ADJUSTABLE LUGGAGE HANDLE

REFERENCE TO RELATED APPLICATIONS

This application claims priority to United States Provisional Patent Application Ser. No. 60/015,622 filed Apr. 19, 1996, now abandoned, entitled "Locking Push Button for an Adjustable Handle Apparatus," the disclosure of which is hereby incorporated by reference.

BACKGROUND OF THE INVENTION

1. Field of the Invention

The invention relates generally to an adjustably extendable wheel handle for use with luggage. More particularly, the invention relates to a mechanism for releasably locking an adjustably extendable handle in various positions on a wheeled luggage case.

2. Background Art

The art of luggage design contains many examples of devices intended to provide easy adjustment of the extension length of wheel handles on wheeled luggage. Recent examples of adjustably retractable handle assemblies for use on luggage include, for example, the following patents: U.S. Pat. No. 5,499,702 to Wang; U.S. Pat. No. 5,497,865 to Yun-Pi; U.S. Pat. No. 5,482,147 to Wang; U.S. Pat. No. 5,476,163 to Wu; and U.S. Pat. No. 5,474,162 to Shyr et al. Nevertheless, a need remains for a simple, inexpensively manufactured, push button-type mechanism for releasably locking in position the extendable wheel handle of an item of wheeled luggage.

SUMMARY OF THE INVENTION

The subject invention permits the user of an extendable/retractable pull handle for wheeled luggage to easily lock and unlock the handle to adjust its extended length. The apparatus of the invention incorporates a single button operatively connected with a cam and cam follower; the cam follower in turn functions to extend or retract a pair of pins into or out of corresponding apertures in slidable pull handle tubes or rods. The apparatus preferably is mounted within or upon the main body of the luggage, and includes a handle grip disposed upon the top ends of the slidable tubes. A single button actuates the cam mechanism, permitting convenient one-handed operation of the adjustment mechanism. A spring biases the button into the position which extends the pins; thus, when the button is not depressed against the bias of the spring, the pins are pushed laterally outward toward the tubes, where the pins may engage regularly spaced apertures in the tubes.

A primary object of the invention is to provide an apparatus for releasably locking in multiple positions the extendable/retractable pull handle on an item of wheeled luggage.

Another object of the invention is to provide an inexpensive, simple, easily manufactured apparatus for releasably locking in multiple positions the pull handle on an item of wheeled luggage.

An advantage of the invention is that it may be operated with one hand.

Thus, according to the invention there is provided an apparatus for selectively locking and releasing an adjustable wheel handle on an item of luggage, the apparatus comprising a housing mounted upon the item of luggage, a cam follower within said housing and having a central hole therethrough, a push button disposed in the housing and having a cam shaft extending through said hole in said cam follower, said push button being linearly movable, a pair of cam surfaces spirally disposed upon said cam shaft in slidable contact with said cam follower, and at least one slide block comprising a proximate end and a distal end, said proximate end pivotally connected to said cam follower, wherein said cam surfaces induce rotation in said cam follower when said push button is moved, and wherein rotation of said cam follower compels shifting movement in said at least one slide block.

BRIEF DESCRIPTION OF THE DRAWINGS

The accompanying drawings, which are incorporated into and form a part of the specification, illustrate a preferred embodiment of the present invention, and together with the written description serve to explain the principles of the invention. The drawings are only for the purpose of illustrating a preferred embodiment of the invention and are not to be construed as limiting the invention.

In the drawings.

DESCRIPTION OF THE PREFERRED EMBODIMENT

Figure 1:
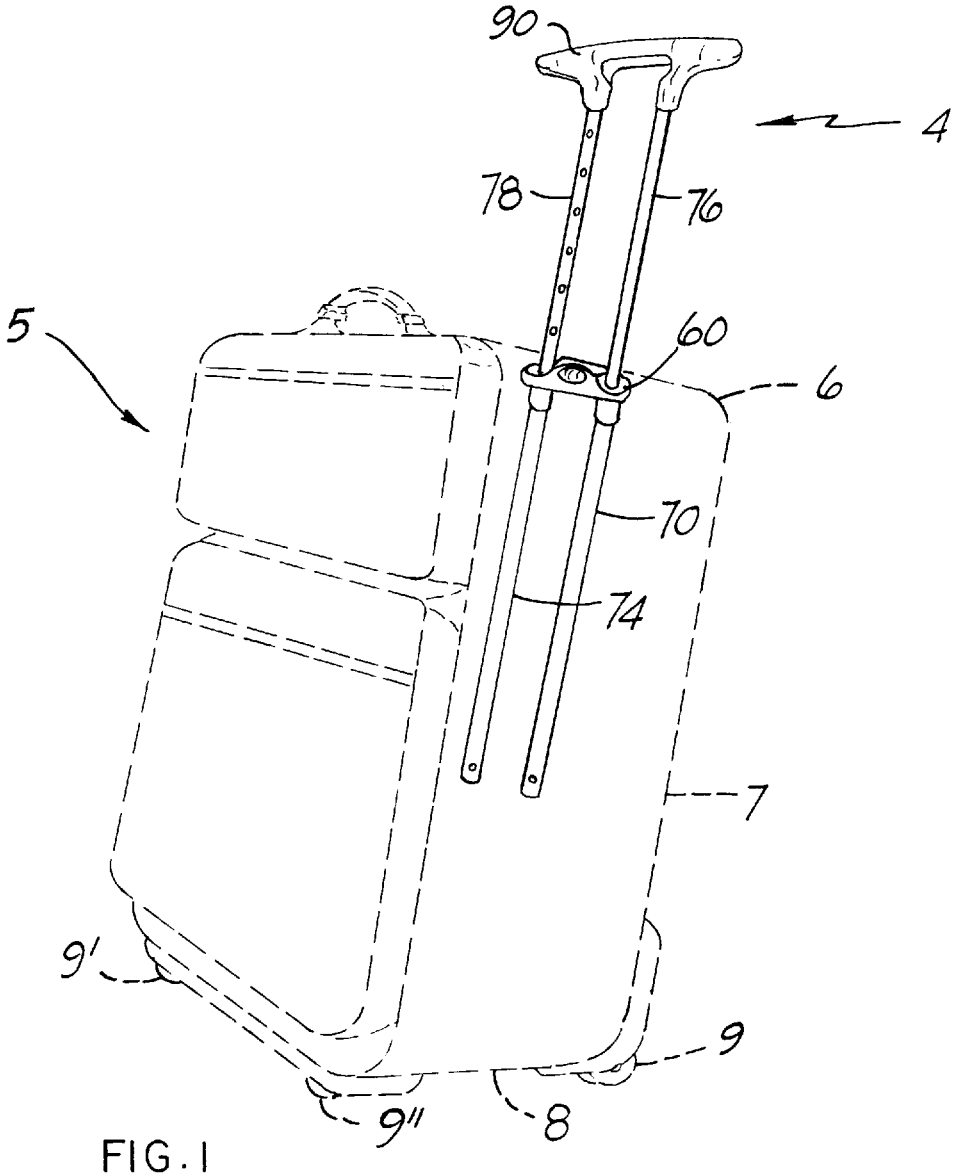
FIG. 1 is a perspective view of a preferred embodiment of the invention on a luggage case, the case being shown by phantom lines.

The subject invention permits the user of an extendable/retractable pull handle for wheeled luggage to easily lock and unlock the handle to adjust its extended length. In the disclosure and claims, "up" and "down" have their ordinary meanings pertaining to the handle assembly 4 of the invention when oriented with respect to a wheeled luggage case 5 as depicted in FIG. 1. "Axial" and "longitudinal" refer to a linear directional orientation generally parallel to the inner tubes 76, 78 of the apparatus shown in FIG. 1, while "radial" and "lateral" refer to directional orientations generally perpendicular to the axes of the inner tubes 76, 78.

FIG. 1 shows that the apparatus of the invention is adapted for use in conjunction with an item of luggage 5 having a top 6, a back 7, and a bottom 8. The inventive handle assembly 4 has beneficial use particularly with a wheeled upright luggage case 5 having at least two and preferably a plurality of wheels 9, 9', 9" mounted upon the bottom 8 in a known manner. The handle assembly 4 is useable to push or pull the rollable case 5 across a supporting surface. As seen in FIG. 1, the assembly 4 is attached to the case 5 substantially adjacent to the intersection of the top 6 with the back 7, for extension and retraction to and from the rearward portion of the top 6.

The inventive handle assembly 4 broadly comprises a handle grip 90 fixed to the ends of a pair of longitudinal inner tubes 76, 78 slidably disposed through a base bezel 60 mounted on the case 5 and into a pair of immobile outer tubes 70, 74. This disclosure and the claims refer to inner "tubes," but it is immediately understood that inner tubes 76, 78 are not necessarily hollow, but may satisfactorily comprise solid longitudinal rods. Hollow outer tubes 70, 74 typically are mounted parallel adjacent to, or within, the back 7. Inner tubes 76, 78 have a diameter less than the inside diameter of outer tubes 70, 74, so that the inner tubes 76, 78 have little contact with the outer tubes 70, 74, but move coaxially within them. Secured to the lower ends of the inner tubes 76, 78 are tube followers 86, 87. The axial movement of the inner tubes 76, 78 is stabilized and controlled by the sliding contact between the inner tubes 76, 78 and the base bezel 60 and between the tube followers 86, 87 and the inside surfaces of the outer tubes 70, 74. The distance between the tube followers 86, 87 and the base bezel 60 varies as the inner tubes 76, 78 move up and down within the immobile outer tubes 70, 74, but remains adequate to maintain the coaxial alignment of inner tubes 76, 78 with outer tubes 70, 74 to prevent racking and binding.

As further described herein, the base bezel 60, which is fixed in position atop the case 5, contains a spring-loaded subassembly including a push button having a cam connection with a pair of laterally movable pins removably insertable into catch apertures serially and linearly disposed along the lengths of each of the inner tubes 76, 78. The spring-loaded subassembly ordinarily maintains the pins in an extended position for engagement into a corresponding pair of apertures in the inner tubes 76, 78 to maintain the tubes in a given position with respect to the case 5. Manual depression of the push button actuates a helical cam to withdraw the pins to permit the inner tubes 76, 78 to slide within the outer tubes 70, 74, and with respect to the case 5, thereby to adjust the position of the handle grip 90.

Figure 2A:
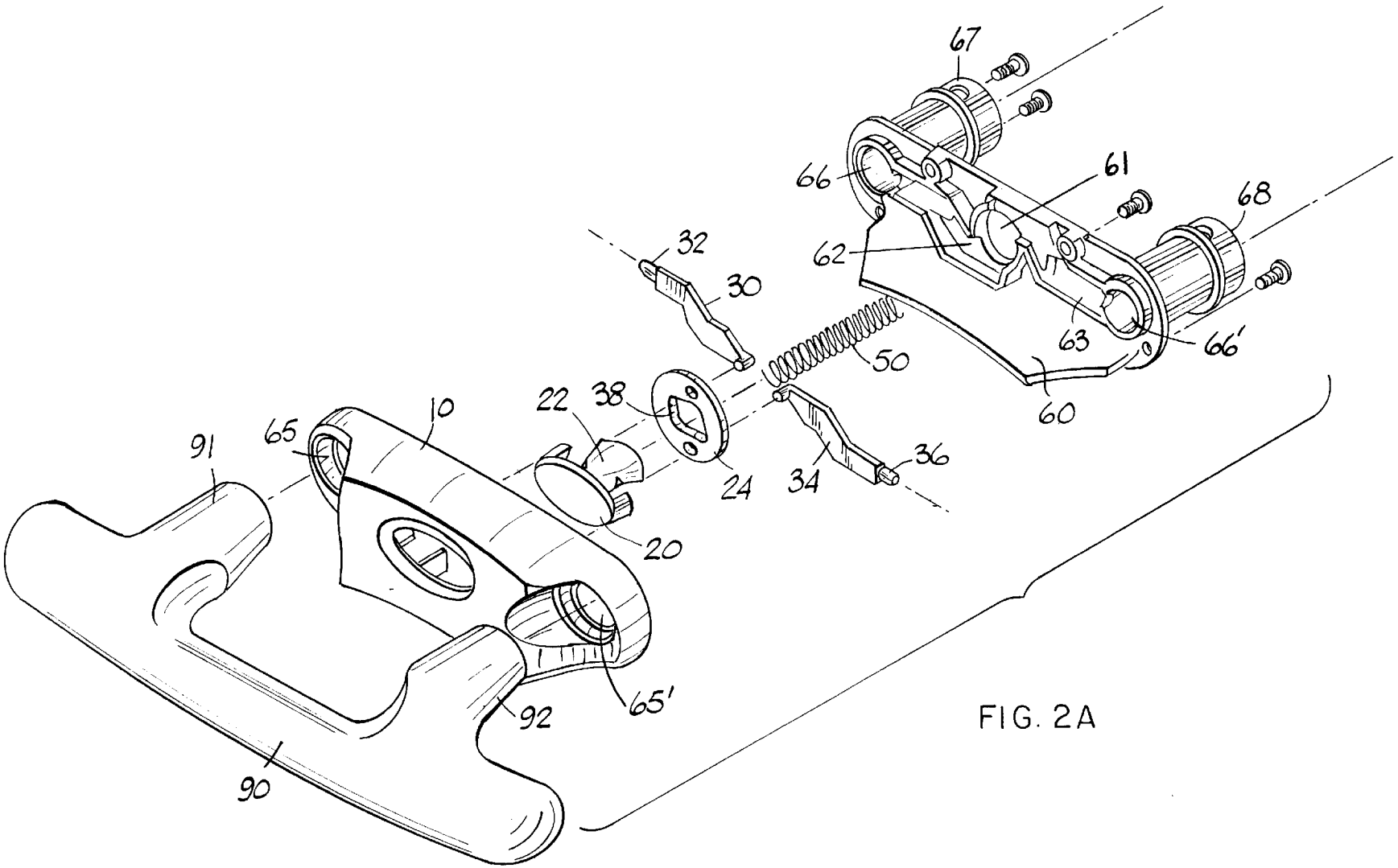
FIG. 2A an exploded view of an upper portion of a preferred embodiment of the invention.
Figure 2B:
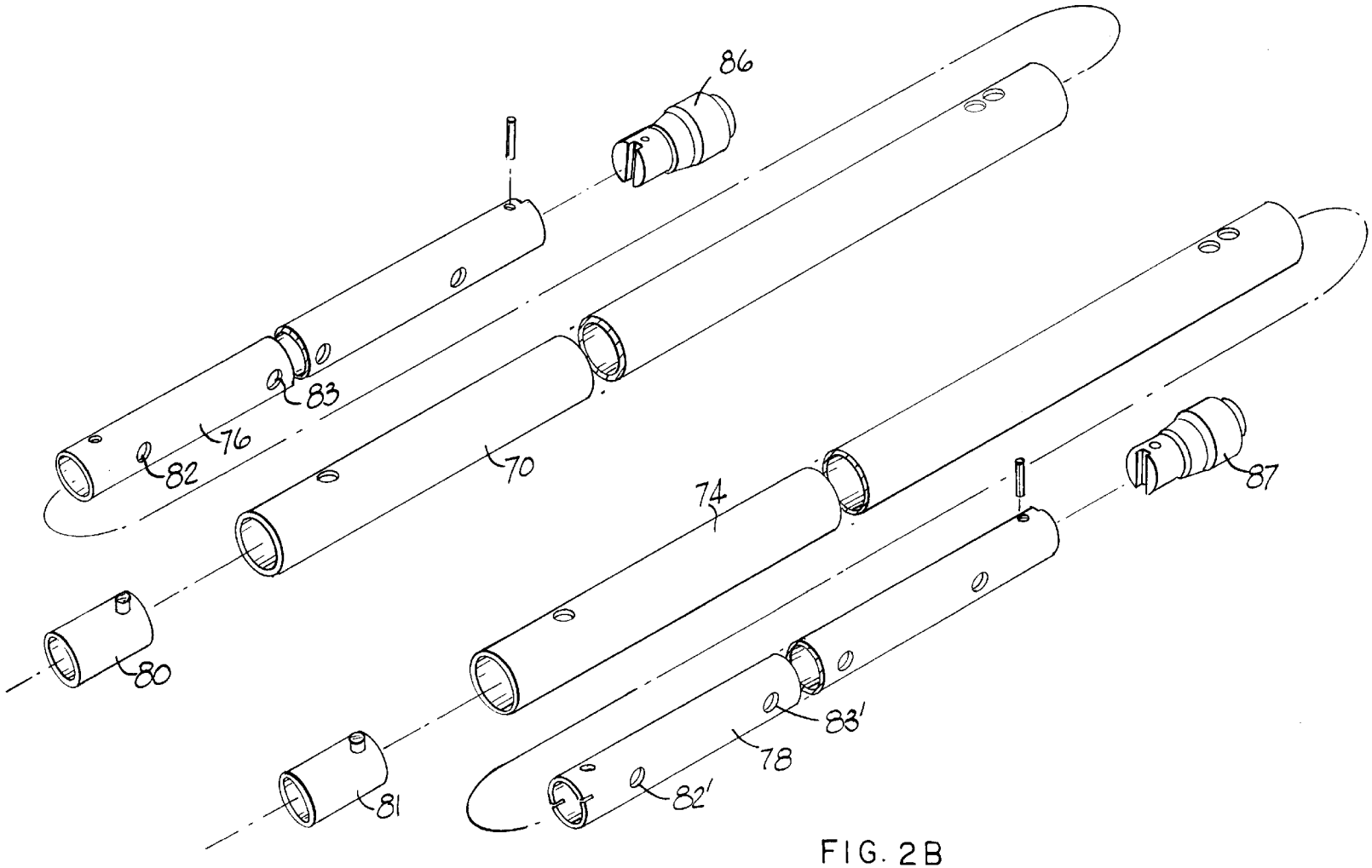
FIG. 2B is an exploded view of a lower portion of a preferred embodiment of the invention, FIGS. 2A and 2B to be considered together to illustrate a complete exploded view of the apparatus of the invention.

As specifically shown in FIGS. 2A and 2B, the handle assembly 4 includes a cover housing 10, a push button 20, a left slide block 30 and a right slide block 34, a cam follower 24, a spring 50, a base bezel 60, the pair of outer tubes 70, 74, the pair of inner tubes 76, 78, and the handle grip 90. The base bezel 60 and cover housing 10, which house the principal functional components of the invention, are secured together by means of screws or the like, and are attached to the body of the luggage case 5 in a known manner. The cover 10 and base bezel 60 define vertical openings 65, 65' and 66, 66' through which the parallel inner tubes 76, 78 are slidably disposed. Inner tubes 76, 78 are connected to molded handle grip 90, preferably by means of connector sleeves 80, 81 adapted for secured insertion into the upper ends of the inner tubes and into the tube barrels 91, 92 of handle grip 90.

Base bezel 60 and cover housing 10 define and enclose a space within which the push button 20, spring 50, cam follower 24 and slide blocks 30, 34 are organized and contained. The base bezel 60 defines a pair of troughs 62, 63 which retain the left and right slide blocks 30, 34, allowing the slide blocks 30, 34 significant lateral (inward and outward with respect to shaft 22) movement only. The troughs 62, 63 allow the slide blocks 30, 34 a very minor amount of side-to-side shifting, perpendicular to their axes of lateral motion, due to the swinging movement of the proximate ends of the slide blocks where they connect with the rotatable cam follower 24. Cam follower 24 and slide blocks 30, 34 preferably are mostly planar, and thus occupy minimal space within the cover housing 10 and base bezel 60. The bezel 60 also defines a boss 61 upon which the spring 50 is vertically positioned. Base bezel 60 also features tube sockets 67, 68 into which the upper ends of the outer tubes 70, 74 are inserted and secured to effectively attach the outer tubes 70, 74 to the base bezel 60, which bezel in turn is fixed upon the main body of luggage case 5.

To allow the user to adjust the extension of the pull handle 4 to a variety of positions, a series of regularly spaced catch apertures 82, 82', 83, 83' are provided in associated pairs along the inwardly facing surfaces of the axial lengths of both inner tubes 76, 78, as shown in FIG. 2B. The catch apertures 82, 82', 83, 83' are positioned so as to be alignable with the pins 32, 36 which project from the distal ends of respective slide blocks 30, 34. The extension of the handle grip 90 from the body of the case depends upon the distance which the inner tubes 76, 78 are drawn upward out of the base bezel 60, as suggested by FIG. 1. As any given pair of catch apertures 82, 82' come into alignment with the positions of the pins 32, 36, the pins 32, 36 are engageable into the apertures 82, 82' to releasably lock the corresponding inner tube 76, 78 in position, prevent it from sliding, and thus temporarily fix the extended length of the wheel handle 4.

The lateral positions of the slide blocks 30, 34, and thus the engagement or non-engagement of the pins 32, 36 into any of the catch apertures 82, 82', 83, 83' are governed by the operation of a push button cam subassembly housed within the cover 10 and base bezel 60, and actuated by the user's manually depressing the push button 20. Reference is made to FIGS. 3A–3E, which show in detail the operative arrangement of the push button cam subassembly comprising the bush button 20, cam follower 24, and slide blocks 30, 34 with pins 32, 36. Push button 20 has a longitudinally extending cam shaft 22 which extends downward through a corresponding central hole 38 through the generally planar cam follower 24 as indicated in FIGS. 2A and 3E. An abbreviated double helix of diametrically opposed cam surfaces 27, 28 project radially from, and spiral down, the length of the shaft 22, as seen in FIGS. 3B–3D. Each surface 27, 28 wraps only partially about the circumference of the shaft 22 through an arc of, preferably, from about 20° to about 30°. The push button 20 is linearly movable axially up and down in the cover housing 10, but is barred against rotation or lateral displacement by, for example, the guiding and constraining contact between the cover 10 and button prongs on the bottom of the push button 20. Button prongs diverging downwardly from the bottom of the push button 20 may also serve to prevent the push button from passing completely through the window in the cover housing 10 through which the button is disposed. The cam follower 24, preferably is in the general shape of a circular disk rotatable about the cam shaft 22 and within the base bezel 60, but is held against axial movement. The slide blocks 30, 34 may neither rotate nor move axially, but shift laterally, radially outward and inward with respect to the cam shaft 22.

Figure 3A:
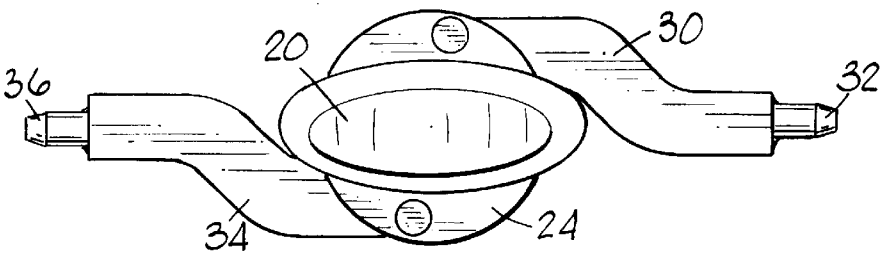
FIG. 3A is an enlarged top view of a portion of the embodiment shown in FIG. 2A, illustrating the push button cam subassembly.
Figure 3B:
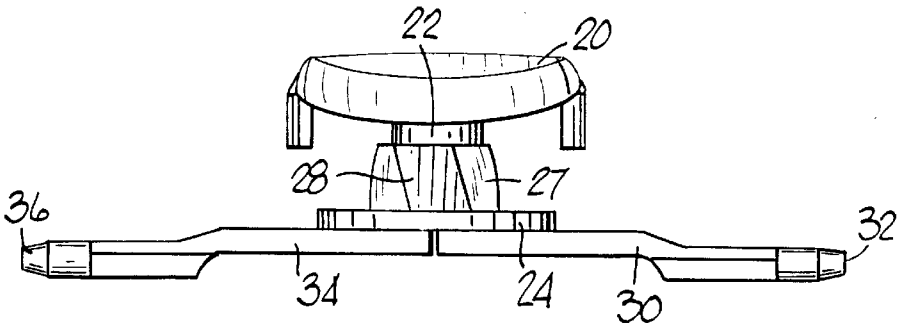
FIG. 3B is a front view of the subassembly shown in FIG. 3A.
Figure 3E:
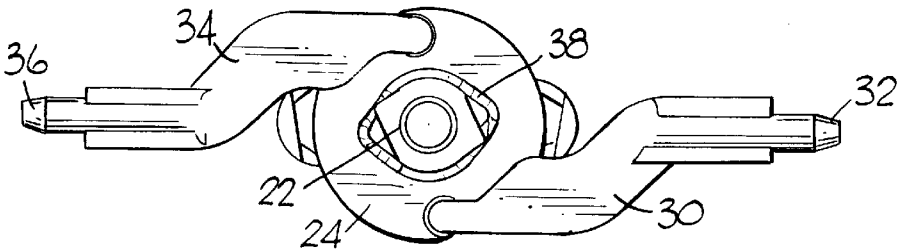
FIG. 3E is a bottom view of the subassembly shown in FIG. 3B.
Figure 3D:
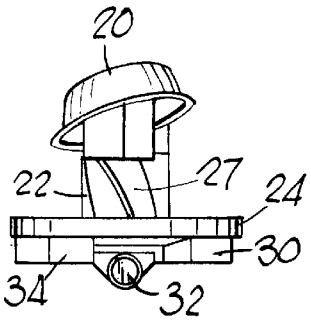
FIG. 3D is a right side view of the subassembly shown in FIG. 3B.
Figure 3C:
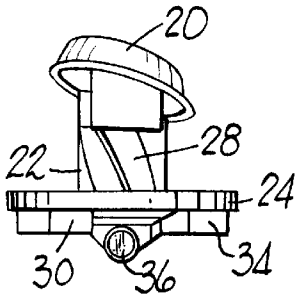
FIG. 3C is left side view of the subassembly shown in FIG. 3B.

The proximate end of each slide block 30, 34 is pivotally connected to the cam follower 24; the pivotal connection preferably is accomplished with small perpendicular posts at the proximate ends of slide block 30, 34 being inserted through, and rotatable in, corresponding apertures through the cam follower 24 at diametrically opposed locations thereon, as seen in FIGS. 2A, 3A, and 3E. By this means, the rotary movement of the cam follower 24 causes in lateral translational movement, in opposite directions, of the slide blocks 30, 34. As best seen in FIGS. 3A and 3E, the slide blocks have a dog-leg or Z-shape, whereby they are attached to the follower 24 on opposite sides thereof, yet permit the lateral alignment of the pins 32, 36 on their respective ends. The dog-leg shape of each slide block 30, 34 also permits the cam follower 24 rotary motion to draw the slide blocks inward toward the shaft 22 without actually contacting or interfering with the shaft.

Figure 4:
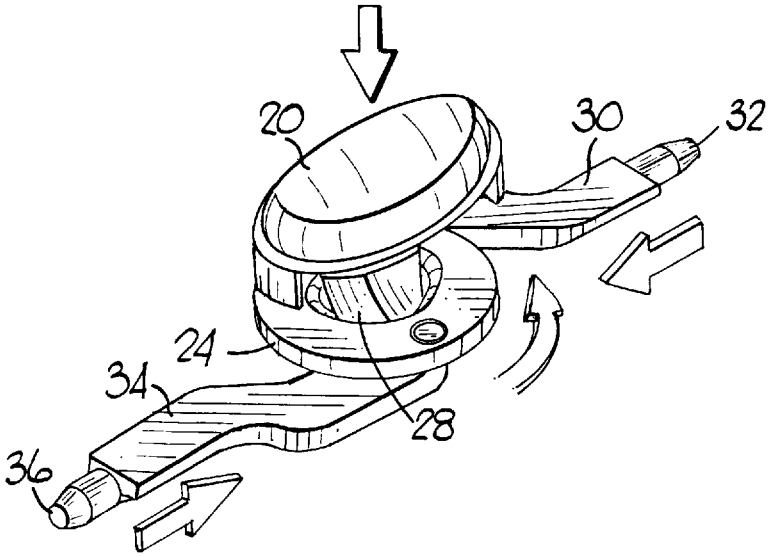
FIG. 4 is a perspective view of the assembly shown in FIG. 3A, taken from above and the left.
Figure 5:
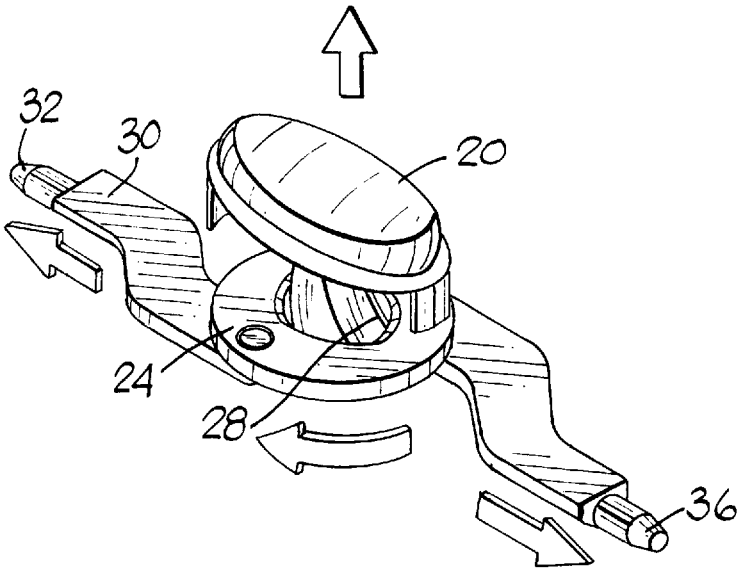
FIG. 5 is another perspective view of the assembly shown in FIG. 3A, taken from above and the right.

As seen in FIGS. 2A and 3E, cam follower 24 has a centrally located, preferably diamond-shaped hole 38 through which the shaft 22 is disposed so to place both cam surfaces 27, 28 in sliding abutment with an interior edge of the cam follower 24. We have determined that a diamond-shape hole 38 advantageously provides rectilinear interior edges on the cam follower 24, which straight edges remain in contact with the cam surfaces 27, 28. The flush contact of a straight edge against the flight of each cam surface 27, 28 promotes a smooth gliding interaction between the cam surfaces and the cam follower which minimizes jams. Alternatively shaped holes 38, such as elliptical holes, may suffice with some reduction in performance. Because of the diamond-shaped or elliptical configuration of the hole 38 and the twisting action of the shaft 22 upon the cam follower 24 due to the movement of the cam surfaces 27, 28, the distance, measured laterally, between the points where the slide blocks 30, 34 connect with the cam follower 24 decreases as the cam follower 24 rotates counterclockwise as seen in FIGS. 4 and 5. Continued downward movement of the button 20 continues the sliding contact between the surfaces 27, 28, and induces the cam follower to rotate through a modest arc, tangentially pulling the slide blocks 30, 34. The slide blocks 30, 34 consequently slide laterally in the bezel 60, thereby withdrawing the pins 32, 36 from the catch apertures in the inner tubes 76, 78.

FIGS. 2A, 3B–3D, 4, and 5 indicate that as the button 20 moves axially to shift the shaft 22 up and down within the cam follower 24, the cam surfaces 27, 28 slidably engage the inside surface of the follower 24 defining the follower hole 38. With the follower 24 rotatable but constrained against axial movement, axial movement of the push button 20 presses the cam surfaces 27, 28 against the inside of the cam follower 24 and, since the surfaces 27, 28 are generally helical, continuing movement of the button 20 causes the surfaces 27, 28 to urge the follower 24 to rotate about the shaft 22. When the push button 20 moves axially upward under the force of the spring 50, the riding contact of the surfaces 27, 28 against the cam follower 24 causes the follower to rotate around the shaft 22, which rotation compels the sliding blocks 30, 34 to shift laterally outward within the troughs 62, 63 in the bezel 60. Likewise, and as indicated by the directional arrows of FIGS. 4 and 5, when the button 20 is depressed downward, the cam surfaces 27, 28 ride against the inside of the cam follower 24 to rotate the follower 24 in the opposite direction to retract laterally the slide blocks 30, 34. In one preferred embodiment, the axial movement of the push button through a distance of about one-fourth of one inch (0.64 cm) results in a lateral movement in each of the pins 32, 36 of approximately one-fifth of one inch (0.50 cm). Thus a comfortable yet functional ratio for push button travel distance to pin movement distance is between about 1.2 and 1.3 to 1.0.

The compressed spring 50 constantly biases the button 20 axially upward. Thus, unless the push button 20 is manually depressed against the force of the spring 50, the force of the spring 50 urges the button 20 axially upward, which counter-rotates the cam follower 24 in the direction opposite the curved directional arrow of FIGS. 4 and 5, and holds the slide blocks 30, 34 in a maximally laterally separated relation and the pins 32, 36 in extended positions. Because the flights of the cam surfaces 27, 28 do not define complete circuits around the shaft 22, the cam follower 24 never completes a full 360° rotation. The rotary motion of the cam follower 24 in alternating directions is converted into reciprocating movements in the slide blocks 30, 34 to engage and disengage the pins 32, 36 from aligned apertures in the inner tubes 76, 78.

In those instances when the ends of the pins 32, 36 on the slide blocks 30, 34 do not happen to be aligned with any catch apertures 82, 82' in the inner tubes 76, 78, the pins 32, 36 simply frictionally ride against the outside surfaces of the inner tubes 76, 78. The inner tubes 76, 78 hold the slide blocks 30, 34 in the retracted position and push button 20 stays in a depressed or "down" position, resisting the force of the spring 50 until such time as the inner tubes 76, 78 are moved up or down to align the pins 32, 36 with catch apertures 82, 82' or 83, 83' thus allowing the slide blocks 30, 34 to slide laterally outward. When the pins 32, 36 align with a pair of catch apertures, e.g. 83 and 83', the push button 20 is free to move axially up under the influence of the spring 50, and slide blocks 30, 34 shift outward to the "lock" positions in which the pins 32, 36 project into the catch apertures 83, 83'.

As indicated by the topmost directional arrow in FIGS. 4 and 5, to unlock or release the pull handle 4, the push button 20 is manually forced downward, overriding the bias of the spring 50. The resulting action of the cam surfaces 27, 28 against the cam follower 24 rotates the cam follower in the direction of the curved directional arrow in FIGS. 4 and 5, which rotation draws the slide blocks 30, 34 laterally inward. The inward movement of the slide blocks 30, 34 releases the pins 32, 36 from the catch apertures 83, 83' in the inner tubes 76, 78, in turn leaving both inner tubes free to slide up or down within the outer tubes 70, 74 to another desired height extension corresponding to some other pair of catch apertures. Once the pull handle 4 thus has been re-adjusted to a second position, the button 20 is released, allowing the pins 32, 36 to be pushed by the action of the spring 50 into the new corresponding pair of catch apertures, for example apertures 82, 82'.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of the patents cited hereinabove are hereby incorporated by reference.

What is claimed is:

1. An apparatus for selectively locking and releasing an adjustable wheel handle on an item of luggage, said apparatus comprising:

a housing mounted upon the item of luggage;

a cam follower within said housing and having an interior edge defining a central hole therethrough;

a push button disposed in the housing and having a cam shaft extending through said hole in said cam follower, said push button and cam shaft being axially movable;

a pair of cam surfaces spirally disposed upon said cam shaft in slidable contact with said interior edge of said cam follower, said cam follower rotatable about said cam shaft; and at least one slide block comprising a proximate end and a distal end, said proximate end connected to said cam follower and said distal end engageable with the wheel handle;

wherein said cam surfaces induce rotation in said cam follower when said push button is moved, and wherein rotation of said cam follower compels shifting movement in said at least one slide block.

2. An apparatus according to claim 1 wherein said cam follower is substantially planar.

3. An apparatus according to claim 2 wherein said cam follower comprises a substantially circular disk, and wherein said at least one slide block comprises two slide blocks connected to said disk at diametrically opposing locations.

4. An apparatus according to claim 1, wherein said central hole in said cam follower is substantially diamond-shaped.

5. An apparatus according to claim 4 wherein movement of said push button in a first direction rotates said cam follower to extend said distal ends of said slide blocks in opposite directions away from each other, and movement of said push button in a second direction counter-rotates said cam follower to retract said distal ends in opposite directions toward each other.

6. An apparatus according to claim 5 further comprising means within said housing for biasing said push button in said first direction.

7. An apparatus according to claim 4 wherein said cam surfaces define a double helix along said cam shaft, one of each said cam surface having sliding contact against a straight edge of said cam follower.

8. In wheeled luggage including a body and an adjustably extendable and retractable wheel handle having a handle grip and a pair of handle tubes slidably movable within the body, each of said handle tubes having a plurality of regularly spaced apertures along at least a portion of the length of the tube; an improved means for selectively locking and releasing the movement of the handle tubes, said improvement comprising:

a housing mounted upon the luggage;

an axially movable push button disposed in the housing and having a cam shaft extending therefrom;

a substantially planar cam follower having at least one interior edge defining a central hole therethrough and rotatable about said cam shaft;

a pair of cam surfaces spirally disposed upon said cam shaft in slidable contact with said at least one interior edge of said cam follower; and two slide blocks movably disposed within said housing, each said block comprising a proximate end and a distal end, said proximate end connected to said cam follower and said distal end comprising a pin alignable with at least one of the apertures in a corresponding one of the handle tubes;

wherein said cam surfaces induce rotation in said cam follower when said push button is moved, and wherein rotation of said cam follower compels shifting movements in said slide blocks.

9. The improvement of claim 8 wherein said cam follower is substantially planar.

10. The improvement of claim 9 wherein said cam follower comprises a substantially circular disk, said slide blocks connected to said disk at diametrically opposing locations.

11. The improvement of claim 8, wherein said cam follower has a plurality of interior edges defining a substantially diamond-shaped central hole, and said cam shaft is disposed through said hole.

12. The improvement of claim 11 wherein said cam surfaces define a double helix along said cam shaft, one of each said cam surfaces having sliding contact against one of said interior edges of said cam follower.

13. The improvement of claim 8 wherein movement of said push button in a first direction rotates said cam follower to extend said pins of said slide blocks toward the handle tubes, and movement of said push button in a second direction counter-rotates said cam follower to retract said pins away from the handle tubes.

14. The improvement of claim 13 further comprising means within said housing for biasing said push button in said first direction.

15. The improvement of claim 14 wherein said means for biasing comprises a compressible spring.

* * * * *